US008863559B2

(12) United States Patent
Czyzewski et al.

(10) Patent No.: US 8,863,559 B2
(45) Date of Patent: Oct. 21, 2014

(54) METHOD FOR WASHING LAUNDRY IN A PROGRAM-CONTROLLED DOMESTIC APPLIANCE, AND CORRESPONDING DOMESTIC APPLIANCE

(75) Inventors: Gundula Czyzewski, Berlin (DE); Ingo Schulze, Panketal (DE); Stephan Sommer, Falkensee (DE); Cornelia Witt, Berlin (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 936 days.

(21) Appl. No.: 12/522,192

(22) PCT Filed: Dec. 19, 2007

(86) PCT No.: PCT/EP2007/064165

§ 371 (c)(1),
(2), (4) Date: Jul. 6, 2009

(87) PCT Pub. No.: WO2008/086932

PCT Pub. Date: Jul. 24, 2008

(65) Prior Publication Data

US 2010/0000026 A1 Jan. 7, 2010

(30) Foreign Application Priority Data

Jan. 15, 2007 (DE) ..... 10 2007 002 184

(51) Int. Cl.

| | |
|---|---|
| ***D06F 33/00*** | (2006.01) |
| ***D06F 39/00*** | (2006.01) |
| ***D06F 39/02*** | (2006.01) |

(52) U.S. Cl.

CPC ..... *D06F 39/005* (2013.01); *D06F 2204/04* (2013.01); *D06F 2202/02* (2013.01); *D06F 2202/10* (2013.01); *D06F 2202/04* (2013.01); *D06F 39/02* (2013.01)

USPC ..... 68/12.22; 68/12.03; 68/12.21; 8/137; 8/158; 8/159

(58) Field of Classification Search

CPC ... D06F 39/005; D06F 39/02; D06F 2202/02; D06F 2202/04; D06F 2202/10; D06F 2204/04

USPC ..... 8/158, 137, 159; 68/12.03, 12.21, 12.22

See application file for complete search history.

(56) References Cited

U.S. PATENT DOCUMENTS

| | | | | |
|---|---|---|---|---|
| 4,503,575 | A * | 3/1985 | Knoop et al. | 8/158 |
| 4,643,350 | A * | 2/1987 | DeSchaaf et al. | 236/12.12 |
| 6,269,506 | B1 | 8/2001 | Hollatz et al. | |
| 2005/0252250 | A1 * | 11/2005 | Oh et al. | 68/12.03 |
| 2006/0005318 | A1 * | 1/2006 | Yoon | 8/158 |
| 2006/0107468 | A1 * | 5/2006 | Urbanet et al. | 8/158 |
| 2007/0169283 | A1 * | 7/2007 | Kim et al. | 8/158 |
| 2008/0189875 | A1 | 8/2008 | Czyzewski et al. | |

FOREIGN PATENT DOCUMENTS

| | | | | |
|---|---|---|---|---|
| DE | 2920492 | A1 | 12/1979 | |
| DE | 3126135 | C1 | 10/1982 | |
| DE | 3206563 | A1 | 9/1983 | |
| DE | 19705666 | A1 * | 8/1998 | G05D 23/19 |
| DE | 10017160 | C1 | 4/2001 | |
| DE | 10138067 | A1 | 2/2003 | |
| DE | 19906723 | B4 | 11/2006 | |
| EP | 1452636 | A2 | 9/2004 | |

OTHER PUBLICATIONS

DE 19705666 A1—Machine Translation.*

* cited by examiner

*Primary Examiner* — Michael Kornakov
*Assistant Examiner* — Marc Lorenzi
(74) *Attorney, Agent, or Firm* — Nixon & Vanderhye, P.C.

(57) ABSTRACT

A method for washing laundry in a program-controlled domestic laundry-care appliance including the steps of heating washing liquid present in the tub and heating the washing liquid to a specific washing temperature set as a function of determined parameter values that are specific to the laundry being washed and/or the appliance.

14 Claims, No Drawings

METHOD FOR WASHING LAUNDRY IN A PROGRAM-CONTROLLED DOMESTIC APPLIANCE, AND CORRESPONDING DOMESTIC APPLIANCE

This application is a U.S. National Phase of International Application No. PCT/EP2007/064165, filed Dec. 19, 2007, which designates the U.S. and claims priority to German Application No. 10 2007 002 184.6, filed Jan. 15, 2007, the entire contents of each of which are hereby incorporated by reference.

BACKGROUND OF THE INVENTION

The present invention relates to a method for washing laundry items in a program-controlled domestic laundry-care appliance, in particular a washing machine, in which washing liquid present in a tub is heated and a wash temperature is set. The invention also relates to a program controlled domestic appliance for washing laundry items by means of a washing liquid, with a tub to hold the washing liquid and a heating unit to heat the washing liquid to a wash temperature and a programmed controller.

A method for washing laundry in a program-controlled washing machine and a corresponding program-controlled washing machine are known from DE 199 06 723 B4. A wash temperature is set as a function of a selected wash program.

A method for setting the washing liquor temperature by means of a temperature measurement in a program-controlled drum-type washing machine is also known from DE 31 26 135 C1.

The washing of laundry items from a batch of laundry in a domestic laundry-care appliance, in particular a washing machine, generally takes place in three phases. In a first phase water is let in and the laundry introduced into the drum of a washing machine for washing purposes is wet. In this first phase the laundry in the inner drum is wet with the washing liquid or washing liquor which is present in the tub of the washing machine. In a second phase heating takes place to the respective target temperature of the selected wash program. In this process a heating unit is actuated in a predominantly continuous manner. Heating in this second phase is only interrupted in certain programs or program modifications. However in most cases this results in a corresponding extension of the overall wash time. In a third phase, referred to as the post-wash phase after the target temperature has been reached, temporally limited subsequent heating takes place to some degree over a predefined hysteresis in temperature regulation. In other instances once the target temperature has been reached, subsequent heating is excluded.

Heating of the batch of laundry in the second phase and any subsequent heating in the third phase each take place indirectly by way of the washing liquor. To this end a heating element is generally disposed in the lower part of the tub. The washing liquor is heated by the heating element. When the drum moves, other laundry items come into contact with the heated washing liquor. The laundry is heated by means of the exchange between the free and bound liquor.

Since the laundry in a batch of laundry is not heated directly but indirectly by way of the washing liquor, depending on the type of textile and quantity of textile there is a temperature gradient between the interior of the batch of laundry and the free liquor surrounding it. This temperature gradient is steeper, the smaller the exchange between the free and bound liquor. A larger load quantity, a diminishing fall mechanism due to a high fill ratio and a reducing ratio of free to bound liquor also significantly increase this temperature gradient.

This means that in the case of a large load the mean temperature of the batch of laundry, in other words the "laundry temperature", is significantly below the temperature of the washing liquor surrounding the laundry items, in other words the "washing liquor temperature". With the short wash times that are standard for domestic appliances, this can mean that the mean laundry temperature remains below certain minimum values, for example below 50° C. for adequate bleach activation, thus having a markedly adverse effect on the wash performance.

A qualified improvement can be achieved in this context by correspondingly extending the washing time, in some instances with subsequent heating. However this in turn means a significant extension of the washing time, which the user does not want.

BRIEF SUMMARY OF THE INVENTION

The object of the present invention is therefore to create a method, with which the washing time can be shortened whilst still allowing improved cleaning of the laundry items to be achieved. A correspondingly enabled domestic appliance is also to be specified.

With an inventive method for washing laundry items in a program-controlled domestic laundry-care appliance washing liquid present in a tub is heated and a wash temperature is set, parameters specific to the laundry items and/or parameters specific to the domestic appliance and operating parameters are captured and heating of the washing liquid is carried out as a function of these parameters to set a specific wash temperature.

With an inventive program-controlled domestic appliance for washing laundry items by means of a washing liquid, with a tub to hold the washing liquid and a heating unit to heat the washing liquid to a wash temperature and a programmed controller, provision is made for the controller to be set up to capture parameters that are specific to the laundry items and/or the domestic appliance and to control the heating unit as a function of the parameters for heating the washing liquid to set a specific wash temperature.

DETAILED DESCRIPTION OF THE INVENTION

According to one preferred embodiment of the present invention, the wash temperature is tailored specifically, in particular by the programmed controller, to the instantaneous individual situation of the washing operation, thereby allowing an improved washing operation. The wash temperature to be actuated and the heating process are tailored to previously captured state variables of the washing process. It is thus possible to shorten the times required to reach the mean wash temperature specifically and thus also to realize shorter wash programs. It is also possible to achieve better uniformity of the washing operation, allowing an improved wash performance even with the most diverse laundry items and relatively large loads.

The energy input to be provided in particular by the heating unit of the domestic appliance to set a mean wash temperature is preferably determined as a function of the captured parameters. The necessary energy input is preferably generated in particular by corresponding control of the heating unit in at least two different phases, in particular as a function of the progress of the selected wash program, with predefined temperature peaks. Provision is made in particular for the energy input to be generated before the wash temperature drops below a lower temperature limit value.

The wash temperature is preferably set as a function of the value of a temperature gradient occurring during or after a change in the operating state of the heating unit to heat the washing liquid. The quantity and/or absorbency of the laundry items in the drum is/are preferably taken into account when evaluating the temperature gradient, in particular when setting the wash temperature.

Heating of the washing liquid is controlled particularly preferably as a function of the captured parameter values by an expert system realized in particular in the programmed controller.

The load quantity and/or the absorbency of the laundry items is/are captured as parameters specific to the laundry items, in particular with an appropriate sensor system that is essentially known and assigned to the programmed controller. Provision can also be made for the target temperature of the selected wash program and/or the mean water level in the tub during a heating phase and thus in particular during a previously described second phase of the washing operation and/or the appliance temperature and/or the ambient appliance temperature to be captured as parameters specific to the appliance and operating parameters.

An expert system preferably uses different input values to calculate the necessary energy input to achieve a desired mean wash temperature and controls heating accordingly. In a relatively simple instance this means that for a larger load heating is carried out to a non-critical higher target temperature for the laundry items to be washed. In one particular embodiment the previously determined energy can also be distributed over different phases with predefined maximum temperature peaks as a function of the program progress. This can be done with forward planning before temperature regulation again drops below the lower temperature limit value. Temperature regulation in the heating process can also be based on an evaluation of the temperature gradient when the heating unit is activated and/or deactivated taking into account the known load, in particular the load quantity and/or absorbency of the laundry items. Provision can also be made for the mean temperature of the laundry in the second phase (heating to the respective target temperature) and the third phase (post-washing after achieving the target temperature) to be regulated by varying a predefined hysteresis.

As well as the specifically achievable shortening for setting the mean wash temperature, it is also possible to guarantee that the mean target temperature is ensured. A highly efficient and time-optimized washing operation is then possible.

The invention claimed is:

1. A method for washing laundry items in a program controlled domestic laundry-care appliance, the method comprising:

heating washing liquid present in a drum to a washing liquid temperature in accordance with a washing program using a heating unit within the appliance and controlled by a programmed controller operatively associated with the appliance;

setting a wash temperature limit value using the programmed controller, the wash temperature limit value being a function of a temperature gradient value across free washing liquid in the drum and washing liquid bound by the laundry items based on captured parameter values, the captured parameter values being determined by a sensor system operatively associated with the appliance and, the captured parameter values being specific to the laundry items and/or the appliance;

determining an energy input required to achieve the wash temperature limit value based on the captured parameter values;

distributing the energy input to the heating unit over different phases of the wash program by achieving predetermined temperature peaks; and applying energy to the heating unit before the washing liquid temperature drops below a lower temperature limit value.

2. The method as claimed in claim 1, wherein determining the energy input required to set the wash temperature limit value includes generating the energy input value in at least two different phases of the washing program as a function of a measured value used to determine advancement of the washing program, with predefined temperature peaks.

3. The method as claimed in claim 1, wherein determining the energy input required to set the wash temperature limit value includes determining the energy input value before the washing liquid temperature drops below the lower temperature limit value.

4. The method as claimed in claim 1, wherein the temperature gradient value is determined during or after a change in the energy input of the heating unit.

5. The method as claimed in claim 4, further comprising taking into account quantity and/or absorbency of laundry items in the drum of the appliance when determining the temperature gradient value.

6. The method as claimed in claim 1, wherein heating of the washing liquid in the drum is controlled via computer-based system as a function of the captured parameter values.

7. The method as claimed in claim 1, wherein setting the wash temperature limit value includes setting the wash temperature limit value as a function of quantity of laundry items in the drum and/or absorbency of laundry items in the drum.

8. The method as claimed in claim 1, wherein setting the wash temperature limit value includes setting the wash temperature limit value as a function of a temperature limit value associated with a selected wash program and/or captured parameter values including a mean water level in the drum during a heating phase and/or a temperature of the appliance and/or an ambient appliance temperature.

9. The method as claimed in claim 8, wherein setting the wash temperature limit value includes setting a higher temperature value as the wash temperature limit value as the load quantity increases.

10. A program-controlled domestic appliance for washing laundry items via a washing liquid, the domestic appliance comprising:

a drum to retain washing liquid;

a heating unit within the appliance to heat a predetermined amount of the washing liquid in the drum to a wash temperature;

a sensor system to capture parameter values that are specific to laundry items and/or the appliance; and a programmed controller programmed to control the heating unit as a function of a temperature gradient value across free washing liquid the drum and washing liquid bound by the laundry items based on the captured parameter values to heat washing liquid its the drum to the wash temperature and the controller programmed to calculate an energy input required by the heating unit to achieve a mean wash temperature based on the captured parameter values, distribute the energy input to the heating unit over different phases of a wash program, calculate predetermined temperature peaks, and apply energy before the temperature drops below a minimum predetermined value.

11. The method as claimed in claim 1, further comprising regulating the wash temperature limit value of the laundry in at least one of a second phase and a third phase of the wash program based on a washing liquid temperature hysteresis.

12. The method as claimed in claim 1, further comprising heating during a second phase wherein the washing liquid in the drum is heated to the wash temperature limit value of the selected wash program, and heating during a third phase after the washing liquid in the drum has been heated to the wash temperature limit value.

13. The program-controlled domestic appliance as claimed in claim 10, wherein the programmed controller is programmed to determine the temperature gradient value during or after a change in the energy input of the heating unit.

14. The program-controlled domestic appliance as claimed in claim 13, wherein the sensor system is programmed to capture quantity and/or absorbency of laundry items in the drum of the appliance, and the programmed controller is programmed to determine the temperature gradient value based on the captured quantity and/or absorbency of laundry items.

* * * * *

UNITED STATES PATENT AND TRADEMARK OFFICE

CERTIFICATE OF CORRECTION

PATENT NO. : 8,863,559 B2
APPLICATION NO. : 12/522192
DATED : October 21, 2014
INVENTOR(S) : Czyzewski et al.

It is certified that error appears in the above-identified patent and that said Letters Patent is hereby corrected as shown below:

In the Claims

Column 4, lines 57-59, Claim 10, lines 12-14: "across free washing liquid the drum and washing liquid bound by the laundry items based on the captured parameter values to heat washing liquid its the drum to" should be corrected to --across free washing liquid in the drum and washing liquid bound by the laundry items based on the captured parameter values to heat washing liquid in the drum to--.

Signed and Sealed this
Third Day of February, 2015

Michelle K. Lee

Michelle K. Lee
*Deputy Director of the United States Patent and Trademark Office*